US005868603A

United States Patent [19]

Allaire et al.

[11] Patent Number: 5,868,603

[45] Date of Patent: Feb. 9, 1999

[54] METHOD FOR EDGE FINISHING GLASS SHEETS

[75] Inventors: Roger A. Allaire, Big Flats; Guy P. Kenney, Painted Post, both of N.Y.; Masayuki Shinkai, Shizuoka ken, Japan; William M. Simpson, Danville, Ky.

[73] Assignee: Corning Incorporated, Corning, N.Y.

[21] Appl. No.: 766,396

[22] Filed: Dec. 12, 1996

[51] Int. Cl.[6] ..... B24B 1/00

[52] U.S. Cl. ..... 451/29; 451/41; 451/44

[58] Field of Search ..... 451/41, 44, 28, 451/29, 42, 38; 225/96.5

[56] References Cited

U.S. PATENT DOCUMENTS

| | | | |
|---|---|---|---|
| 3,040,460 | 6/1962 | Sawyer et al. | 451/41 |
| 4,159,600 | 7/1979 | Kaminski | 451/41 |
| 4,513,543 | 4/1985 | Lawrenson et al. | 451/41 |
| 4,726,500 | 2/1988 | Rock | 225/96.5 |
| 4,995,539 | 2/1991 | Richard | 225/96.5 |
| 5,343,657 | 9/1994 | Ohlin, Jr. | 451/42 |
| 5,593,528 | 1/1997 | Dings et al. | 451/29 |

*Primary Examiner*—James G. Smith
*Assistant Examiner*—Derris H. Banks
*Attorney, Agent, or Firm*—Robert L. Carlson

[57] ABSTRACT

A method and apparatus for edge finishing glass sheets, wherein a polymer film is deposited onto the major surface of the glass sheet. The polymer film is contacted, perforated, or cut using a water jet and the edges of the sheet are then ground or polished The polymer film is cut or perforated in a manner which facilitates against loading of the grinding or polishing device employed.

8 Claims, 2 Drawing Sheets

METHOD FOR EDGE FINISHING GLASS SHEETS

FIELD OF THE INVENTION

The invention relates to a method for edge finishing glass sheets.

BACKGROUND OF THE INVENTION

In the glass finishing art, glass sheets are typically cut into a desired shape, after which the edges are ground and/or polished to remove any sharp corners. This typically involves contact of the glass sheet with a grinding wheel, such as, for example, a abrasive diamond coated grinding wheel. Glass substrates for flat panel displays are finished in this way.

Glass substrates for flat panel displays are often covered with a polymer film prior to their final finishing steps, which typically consist of grinding and/or polishing of the edges of the sheets. The purpose of the polymeric film is to protect the surface of the substrate from any scratches, glass chips, dust, or other airborne matter.

Unfortunately, this can lead to loading of the grinding wheels by the polymer film, which has a negative impact on the manufacturing process. For example, this necessitates having to dress or change the grinding wheels more frequently, and also can lead to lower quality edge grinding.

SUMMARY OF THE INVENTION

The present invention relates to a method of edge finishing glass sheets. In the present invention, a polymer film is adhered to a surface of the glass sheet. The polymer film is then contacted by a water jet to selectively cut or remove portions of the polymer film near the edge of the glass sheet, after which the edge of the glass sheet is ground or polished. The polymer film is preferably cut in a way which facilitates against loading of the grinding or polishing device employed.

For example, in one embodiment the water jet contacts the polymer film in such a way that the polymer film is perforated along a desired path, wherein the path defines an edge portion and a remainder portion of the polymer, and the edge portion is hingedly movable relative to the glass and the remainder portion of the polymer film. In this embodiment, air or liquid (such as may be used for cooling) may be used to propel the edge portion of the polymer film out of contacting relationship with the grinding equipment, thereby preventing loading of the grinding equipment by the polymer film.

In another embodiment, this edge portion may be completely removed by employing the water jet to cut an edge portion of the polymer film away from the remainder of the polymer film which still contacts the glass.

Preferably, only a small portion of the edge is exposed, so that the remainder of the major surface of the glass sheet remains protected by the polymer film. Most preferably, only the outer 0.5 to 5 mm from the edge of the glass sheet is exposed by the lifted or removed edge polymer region.

The present invention facilitates the edge finishing of glass sheets while preventing unnecessary loading of the grinding equipment by the protective polymer film which cover the glass sheets. The present invention is particularly useful for manufacturing glass substrates for flat panel displays.

DETAILED DESCRIPTION OF THE INVENTION

Figure 1:
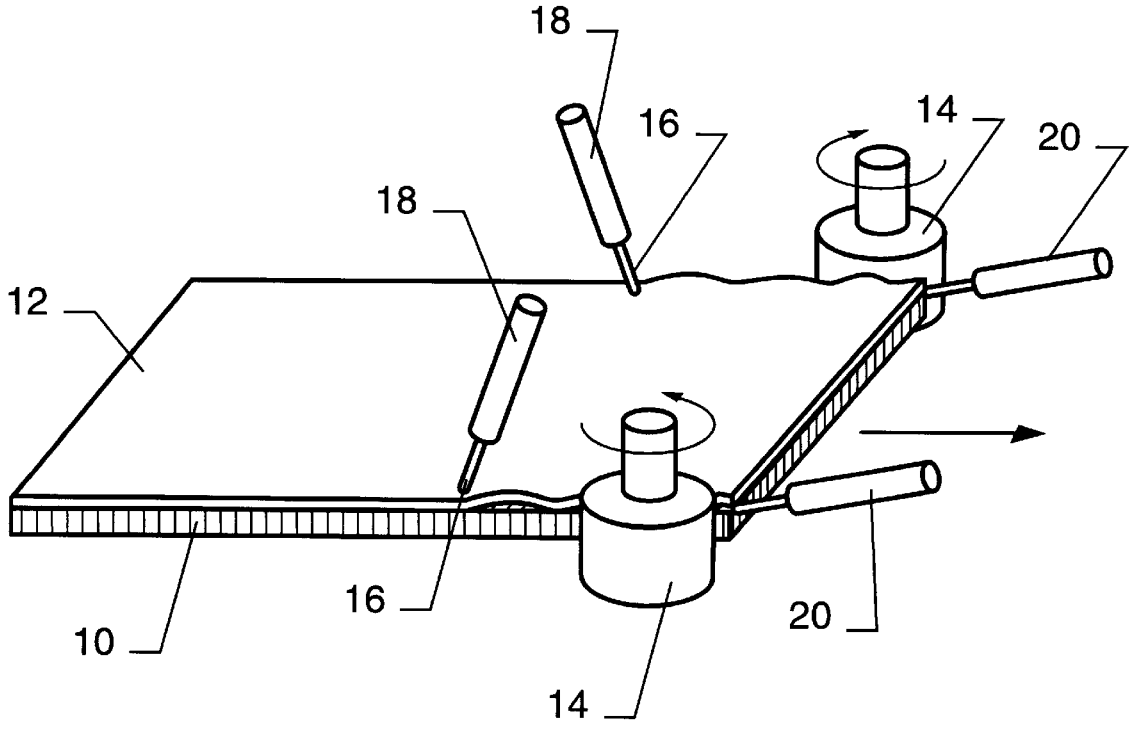
FIG. 1 illustrates a perspective view of a method in accordance with the present invention.

FIG. 1 illustrates a process in accordance with the present invention in which glass sheet 10 having polymer film 12 adhered thereto is being ground and polished by diamond wheel abrasive grinding wheels 14. The glass contacting surface of such grinding wheels 14 typically has a concave shape to thereby grind the corners of the edges of the glass sheet. Prior to contact of the edge of the glass sheet 10 with the grinding wheels 14, the outer edges of the polymer film 12 are contacted by high velocity streams of water 16 which are propelled from water jets 18.

The stream of water 16 perforates or cuts the polymer film in an area relatively close to the edge of the glass sheet 10 which is to be ground or polished. In a preferred embodiment, this contact with the water jet 18 occurs in the outer most 0.5 to 5 mm of the glass sheet. In this way, the majority of the sheet along (parallel to) the edge remains protected during the grinding or polishing operations.

Figure 2:
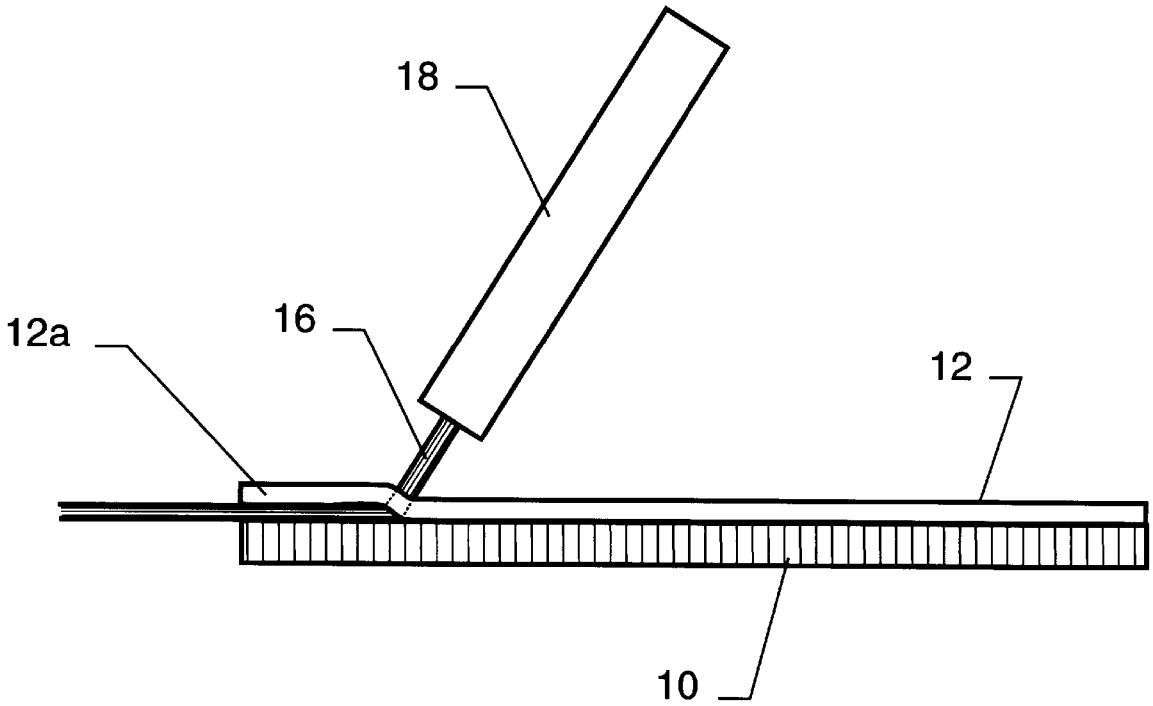
FIG. 2 illustrates a side view of the method illustrated in FIG. 1.

In a preferred embodiment, as illustrated in FIG. 2, the polymer film 12 is perforated by the contact of the water stream 16 to form an outer edge region 12*a* of the polymer film 12 which is hingedly connected to the remainder of the polymer film 12. Such perforation may be achieved, for example, by employing a pulsating water jet 18, or by manipulating the water pressure emitted from the water jet 18 so that it sometimes cuts through the polymer film 12 and sometimes does not.

Consequently, the water spray 20 illustrated in FIG. 1 could be employed to both cool the grinding wheels 14 and propel the outer edge 12*a* of the polymer film away from the edge of the glass sheet during the grinding operation. Thus, in a preferred embodiment the outer edge 12*a* is propelled or bent away from the grinding operation using a water jet or other liquid or gaseous stream.

The polymer film may consist of, for example, a polyethylene film. Such films may be adhered, for example, using adhesives, e.g. a water based acrylic adhesive. By use of water based adhesives, removal via water cleaning is facilitated. In one embodiment the water let 18 consists of a 0.005 inch diameter nozzle opening, through which water is forced at 4800 psi. Using this type of water jet, glass may be easily moved at 4.5 meters per minute with respect to the water jet 18 to thereby impart a perforated line on a polymer film 12 which consisted of a low density polyethylene film (about 90 microns, or 0.0035 inches thick) applied to the glass using a water based acrylic adhesive.

Although the invention has been described in detail for the purpose of illustration, it is understood that such detail is solely for that purpose and variations can be made therein by those skilled in the art without departing from the spirit and scope of the invention which is defined by the following claims.

What is claimed is:

1. A method for grinding or polishing the edges of glass sheets, comprising:

adhering a polymer film to a surface of a glass sheet;

contacting said polymer coating with a water jet to cut portions of said polymer film; and grinding or polishing at least one edge of said sheet using a grinding or polishing device, wherein said cutting of said polymer film facilitates against loading of the grinding or polishing device by the polymer film.

2. The method of claim 1, wherein said contacting step comprises perforating said polymer along a desired path with the water jet to define an edge portion of said polymer on one side of said path and a remainder portion of said polymer on the other side of said path, said edge portion hingedly connected to said remainder portion via said perforated path.

3. The method of claim 2, wherein said grinding and polishing step comprises bending said edge portion along said path out of contacting relationship with said grinding or polishing device during said grinding or polishing step.

4. The method of claim 3, wherein said bending said edge portion away comprises contacting said edge portion with a stream of liquid or gaseous material to bend said edge portion out of contacting relationship with said grinding or polishing device.

5. The method of claim 2, wherein said edge portion formed in said contacting step is between 0.5 to 5 mm from the edge of said glass sheet.

6. The method of claim 2, wherein said coating is perforated in a path parallel to said at least one edge of said sheet.

7. The method of claim 1, wherein said contacting step comprises continuously cutting said polymer film along a line parallel to said edge to thereby remove a portion of said polymer film a chosen distance from the edge of said sheet.

8. The method of claim 1, wherein said chosen distance is between 0.5 and 5 mm from the edge of said sheet, whereby the outermost top edge of said sheet is exposed.

* * * * *